US006941711B2

(12) United States Patent
Pevar

(10) Patent No.: US 6,941,711 B2
(45) Date of Patent: Sep. 13, 2005

(54) HANDICAP ACCESSIBLE CONSTRUCTION UTILIZING RAMPS CONNECTING BUILDING LEVELS SEPARATED BY HALF STORY HEIGHT

(76) Inventor: Marc D. Pevar, 606 Ridge Ave., Kennett Square, PA (US) 19348

( * ) Notice: Subject to any disclaimer, the term of this patent is extended or adjusted under 35 U.S.C. 154(b) by 0 days.

(21) Appl. No.: 10/058,914

(22) Filed: Jan. 28, 2002

(65) Prior Publication Data

US 2003/0140580 A1 Jul. 31, 2003

(51) Int. Cl.[7] ..... E01F 9/00

(52) U.S. Cl. ..... 52/175; 52/174; 52/176; 52/236.3; 52/236.4

(58) Field of Search ..... 52/174, 175, 176, 52/236.4, 236.3, 79.1; 14/69.5

(56) References Cited

U.S. PATENT DOCUMENTS 4,376,596 A * 3/1983 Green ..... 404/35
4,555,877 A * 12/1985 Libra ..... 52/79.4
4,596,097 A * 6/1986 Stewart et al. ..... 52/185
4,807,317 A * 2/1989 Quinn et al. ..... 14/69.5
4,865,312 A * 9/1989 Katz ..... 472/116
4,998,313 A * 3/1991 Lippka et al. ..... 14/71.1
5,457,837 A * 10/1995 Zuckerbrod ..... 14/69.5
5,749,186 A * 5/1998 Kaufman et al. ..... 52/236.3
6,209,270 B1 * 4/2001 Johnston ..... 52/175
6,550,197 B1 * 4/2003 Gray ..... 52/236.3

OTHER PUBLICATIONS

6 Story Building with Attached Parking Structure, The Steinberg Collaborative, AIA, LLP.*

* cited by examiner

*Primary Examiner*—Carl D. Friedman
*Assistant Examiner*—Chi Q. Nguyen
(74) *Attorney, Agent, or Firm*—Laurence A. Weinberger

(57) ABSTRACT

Barrier-free multiple level residential housing can be constructed by employing ramps between adjacent housing levels where the housing levels are offset by one half the normal full story height found in multiple story houses. The ramps are constructed in a stacked and side-by-side manner so that the full standard height between housing levels is maintained between the ramps that are stacked one above the other.

26 Claims, 12 Drawing Sheets

HANDICAP ACCESSIBLE CONSTRUCTION UTILIZING RAMPS CONNECTING BUILDING LEVELS SEPARATED BY HALF STORY HEIGHT

BACKGROUND OF THE INVENTION

1. Field of the Invention

The invention relates generally to design of handicap accessible buildings and more particularly to the design of buildings permitting handicap barrier-free access to multiple building levels without the use of mechanical lifting devices.

2. Background Art

Barrier-free access to building environments especially to living environments is an absolute essential for persons having limited mobility. The degree of limited mobility depends, of course, on the nature of an individual's handicap. However, the single most commonly faced problem by handicapped individuals is the requirement to negotiate stairs which interconnect the living environments in their residence. For some the barrier of the stairs is a minor impediment, but for others stairs present a significant, if not overwhelmingly impossible, barrier to overcome. Significantly, the construction cost, both for new construction and for retrofit construction, for providing barrier-free access is very expensive well exceeding the standard costs for non barrier-free construction.

Before the instant invention, the design of barrier-free handicap accessible living environments was accomplished in one of three principle ways: (1) Single level design; (2) mechanical lifting devices; or (3) ramps connecting full-height living levels. In the case of single level design, the entire building environment must be built on one level ("ranch" style design). This design option requires a building foot-print that is of a size equal to the total building environment. In comparison to multi-level designs, the ranch design uses the most land, and therefore will not fit on many building lots where multi-level designs will fit. A ranch design, in comparison to a multi-level design, requires the greatest amount of excavation, foundation, exterior walls, concrete floor slab and roof in proportion to the total livable space. As a consequence of this inherent inefficiency, ranch designs cost more than multi-level building designs to build for the same area of livable space. The ranch design eliminates the need for mechanical lifting devices because there are no multiple levels but at a higher construction cost and restriction on the building lot size availability.

Mechanical devices can be used to provide access between multiple levels. For example multiple building levels can be interconnected and thereby accessed by means of mechanical devices that lift an individual or a wheel-chair from one level to another. A lifting device such as an elevator, wheel-chair lift, stair-climbing chair, moving stairway, etc. can be incorporated into the design. Mechanical devices such as these permit the designer to enjoy the cost and land saving benefits that derive from multi-level building design. However, all mechanical designs require significant initial costs for: (1) structural improvements required to accommodate the devices; (2) the devices themselves; and (3) installation of the devices. Additionally, mechanical designs are subject to on-going expenses, risks and inherent design limitations related to inspection, maintenance, repair, replacement, and limited lifting capacity and the limited area that moves between the multiple building levels.

For example, at the time of initial construction, a person may require a small elevator suitable only for one person to stand. Subsequently, increased disability may require the use of a wheelchair that requires a larger sized and increased weight-lifting capacity elevator. Also mechanical devices require electricity and have wearing parts and can, therefore, become inoperative because of power failure or mechanical breakdown. Handicapped individuals may become stranded or trapped in life-threatening circumstances in the event of power failure or mechanical breakdown.

Ramps are the third design option that permits barrier-free access to building environments. Ramps are sometimes used to interconnect multiple building levels for both commercial and residential uses. However, to be accessible for both able and disabled individuals, ramps can not exceed certain design limitations regarding their slope. For example, there are physical limits on how steep a slope can be for comfortable use by an able-bodied individual as well as partially disabled individuals. There are also physical limits on how steep a slope can be, in combination with the spacing of intermediate landings, for practical and comfortable use by individuals who propel themselves by hand-power in a wheel chair. There are also safety limits on how steep a slope can be used by persons in either hand-powered or motorized wheel chairs. This safety issue arises because there is a risk that a wheel chair may topple forward or backward or sideways because such chairs have a relatively high and therefore inherently unstable center of gravity.

In this connection, the American Disabilities Act Accessibility Guidelines ("ADAAG") as amended in 1998 contains specifications for publically accessible new construction that are widely accepted throughout the United States of America for ramp design. The ADAAG defines a ramp as "walking surface which has a slope in the direction of travel that is greater than 1:20" (5% grade) (reference ADAAG 3.5). ADAAG section 4.8.2. specifies ramp design as follows:

> 4.8.2* Slope and Rise. The least possible slope shall be used for any ramp. The maximum slope of a ramp in new construction shall be 1:12. The maximum rise for any run shall be 30 in (760 mm).

Additionally, the ADAAG requires a level maneuvering space that is at least five feet long at the bottom and top of every ramp. These design parameters result in a significantly long ramp where the total rise from one living level to another is nine feet (or one hundred eight inches).

Because the maximum rise per run may be no more than thirty inches, a one hundred eight inch rise requires four ramp segments, each connected to the other by a sixty inch level landing. The total run of ramps also requires an additional sixty-inch level maneuvering area at the top and bottom of the highest and lowest ramps in the run of ramps. Five landings are therefore required, for a total of three hundred inches of level run for all landings. Additionally, the four ramps comprise a total horizontal run of one thousand, two hundred, ninety-six inches (108"×12=1,296"). The total required run of ramps and landings is therefore one thousand, five hundred, ninety-six inches, or a total horizontal run of one hundred thirty-three feet.

Typically ramps designed to the full ADAAG standard become so long that it is impractical to fit them into most allowable housing footprints or residential building lots. In some cases, although the ramp may fit within the allowable footprint, the cost of the ramp in proportion to the other costs of the building's usable space becomes prohibitive. In residential construction, shorter length ramps with greater slope may be used depending on the nature and extent of the person's disability. What is required therefore is a way to incorporate relatively shallow ramps in residential construction at reasonable cost to provide access to multi-level dwellings.

BRIEF DESCRIPTION OF THE DRAWINGS

FIG. 3B depicts how the split-level ramp-well does not have to be in one straight orientation, but rather can have any desired angle that interrupts the direction of travel along the ramp-well.

FIG. 6 depicts ramps AB and CD, which are stacked above one-another. FIG. 6 does not depict ramp BC which is built beside ramps AB and CD and therefore is out of the plane that is depicted by FIG. 6.

FIG. 7 depicts ramp BC. FIG. 7 does not depict ramps AB and CD which are built beside ramp BC and therefore are out of the plane that is depicted by FIG. 7.

FIG. 8 depicts ramps AB, BC and CD. FIG. 8 depicts how levels A and C are stacked above one-another, while levels B and D are also stacked above one-another. FIG. 8 additionally depicts how these two groups of stacked levels are offset from one-another by half-story increments.

DESCRIPTION OF THE INVENTION

Figure 1:
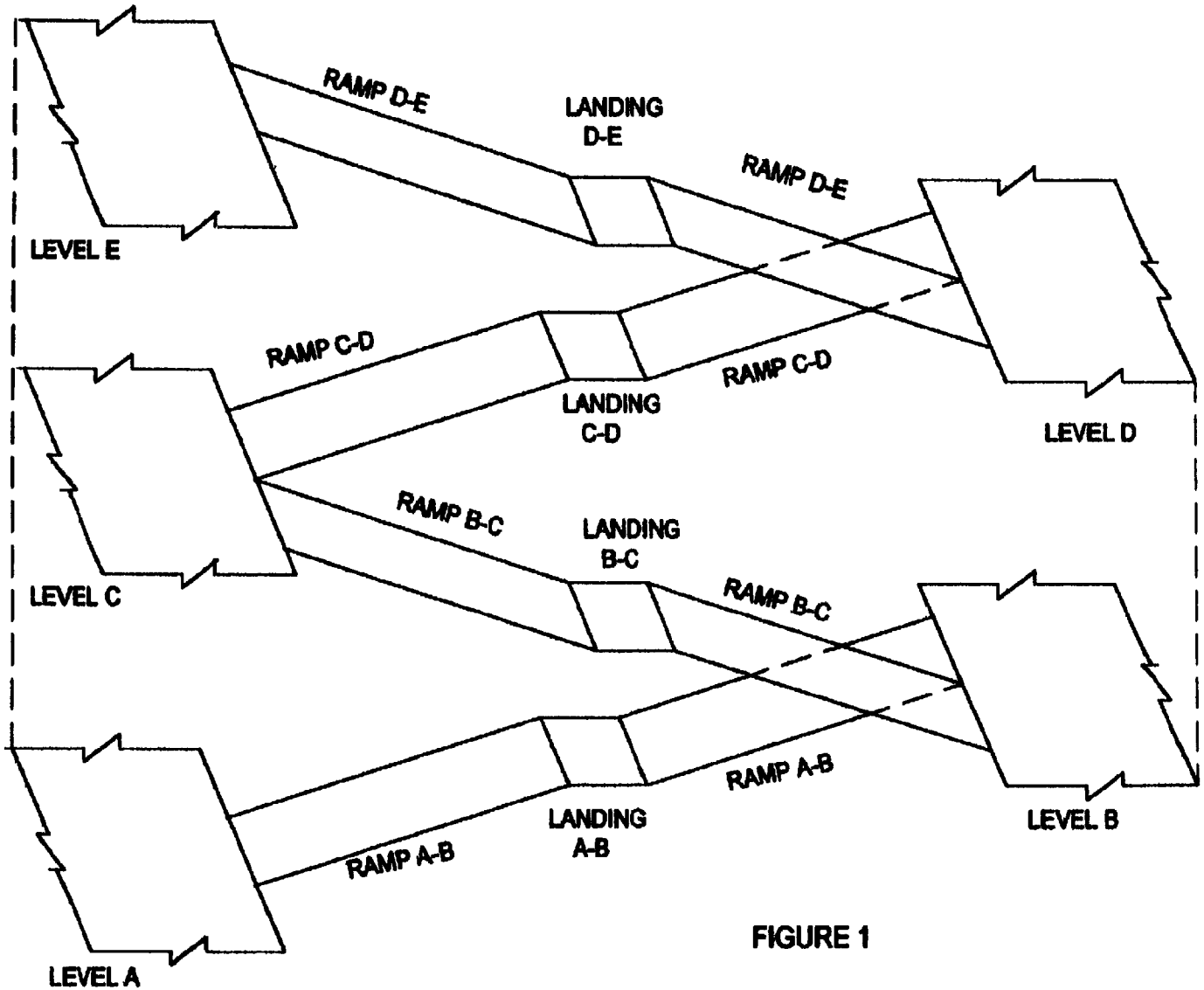
FIG. 1 shows a split-level ramp-well, isometric schematic view, depicting how the ramps are built side-by-side and are stacked one above the other, thereby providing access to building environments that are off-set at half-story increments.

The present invention uses similarly sloped vertically stacked ramps to connect multiple building levels with oppositely sloped vertically stacked ramps that connect the intermediate levels, each building level being separated from each other by one-half story as shown schematically in FIG. 1. The total horizontal run of ramps required to provide access from one building level to another is thereby reduced by fifty percent. This means that the total run of ramps and level maneuvering spaces required to meet the maximum ADAAG design guidelines for access to different living levels reduces from one hundred thirty-three feet to sixty-six and one half feet. This reduced requirement for building lot length and the cost to construct is so significant that using ramps as a way to interconnect multiple building levels becomes a practical option instead of an impractical or impossible goal.

Figure 2:
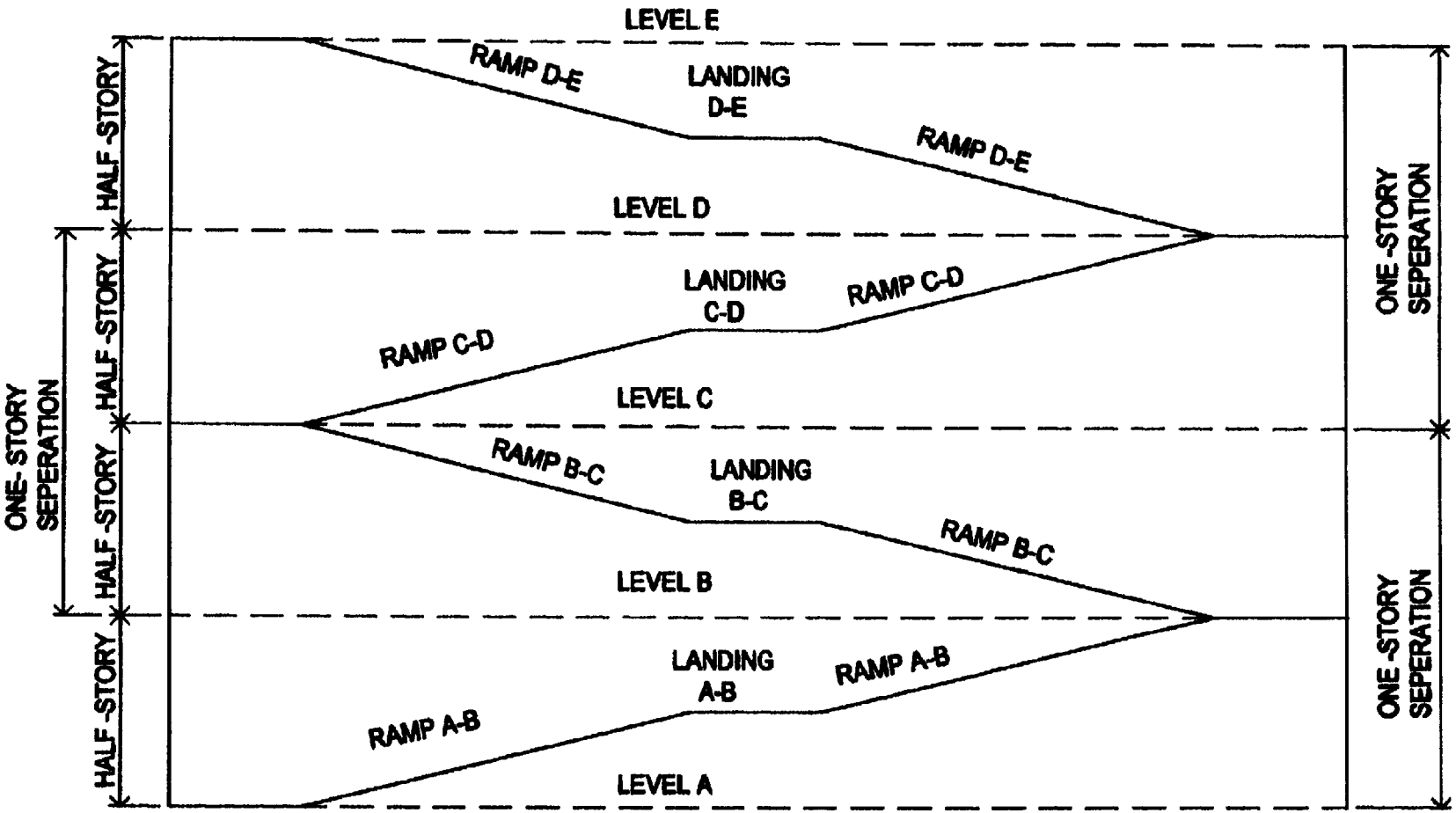
FIG. 2 shows a split-level ramp-well, schematic side view, depicting how the ramps are stacked one above the other, thereby providing access to building environments that are off-set at half-story increments.

Few building designs can accommodate a ramp run of one hundred thirty-three feet because of the size of building lots and the extra cost required for foundations, roof and the construction of such a long ramp system. By reducing the size and cost requirements by fifty percent, this invention makes the use of ramps as a means of connecting building levels both more affordable and also more practical because of building lot sizes. As shown in FIG. 1 and FIG. 2, this invention off-sets, successive building levels by half-story increments of four and one half feet rather than the nine feet typically found in multiple story residential construction. In this respect, a residence built according to this invention resembles a split-level house. As noted, if a building were built to ADAAG standards using this invention, the total run would only be sixty-six and one half feet long. Also, as noted, shorter ramps with a greater slope may be used in residential construction depending on the nature and extent of the person's disability.

For instance, a steeper slope of 16.07% is practical for walking purposes. Furthermore, this slope can be negotiated easily by a motorized wheelchair. Furthermore, a 16.07% slope does not pose a risk for off-balance tipping for users of motorized wheel chairs. When a 16.07% slope is used, a total rise of four and a half feet requires only a 28 foot ramp. Incorporating a recommended level landing half way divides the ramp into two 14 foot sections. In addition to the preferred intermediate landing, a preferred design requires two level maneuvering spaces of 5 feet each (1 bottom and 1 top) at either end of the ramp. These spaces are part of each residential level which should be kept clear of obstacles. All totaled, the three spaces (intermediate landing, top and bottom maneuvering spaces) add an additional 15 feet to the total run of the ramp system. Thus, using a 16.07% slope, the total horizontal run of the ramps and required landings is forty-three feet. Of course, a shorter total distance is possible if the landing size and maneuvering spaces are reduced and if a greater slope is used.

Figure 4:
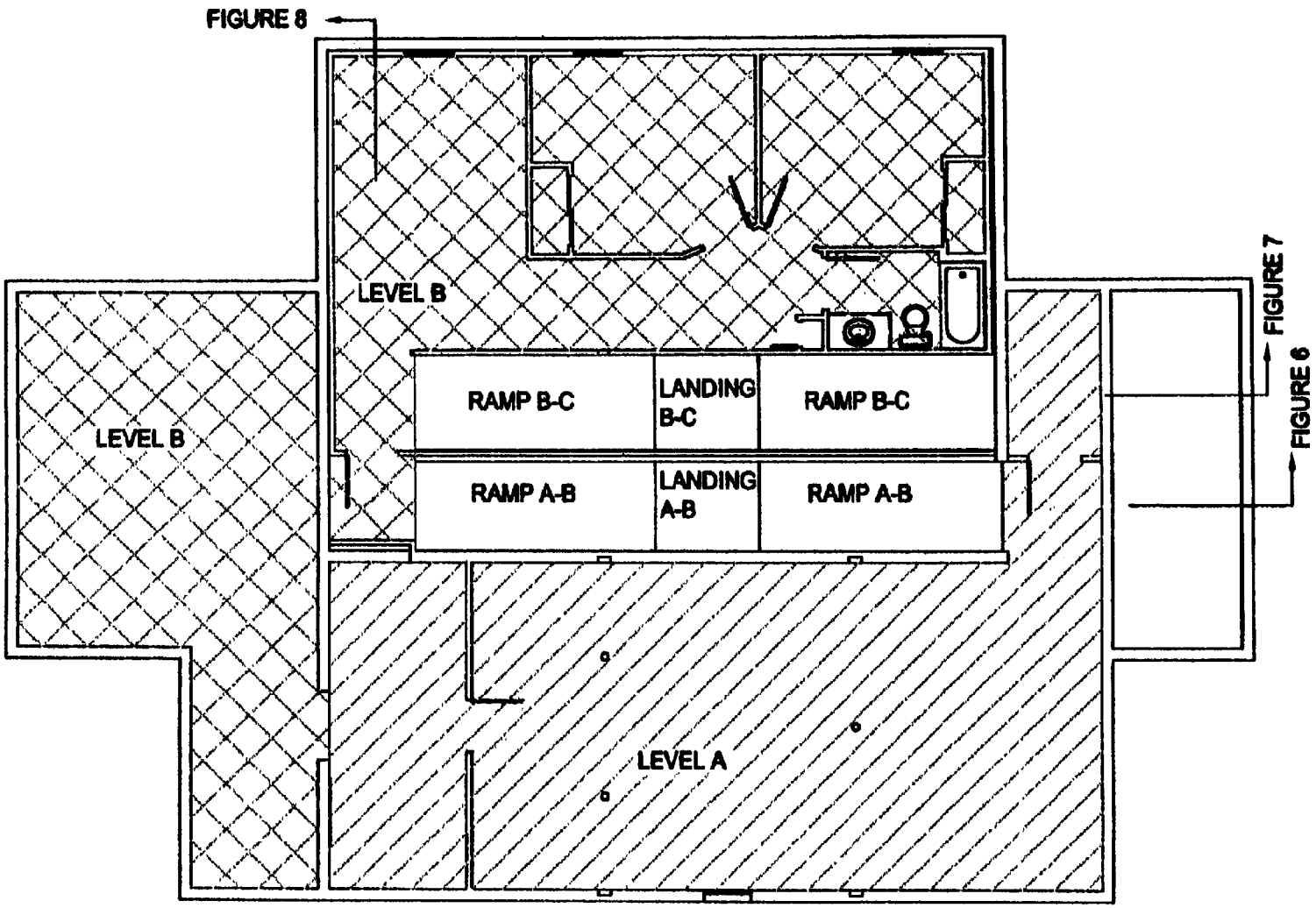
FIG. 4 shows a plan view of a single-family residential building design that incorporates this invention, depicting levels A and B and indicating the location within this design of sectional views that are themselves depicted in FIGS. 6, 7 and 8.
Figure 5:
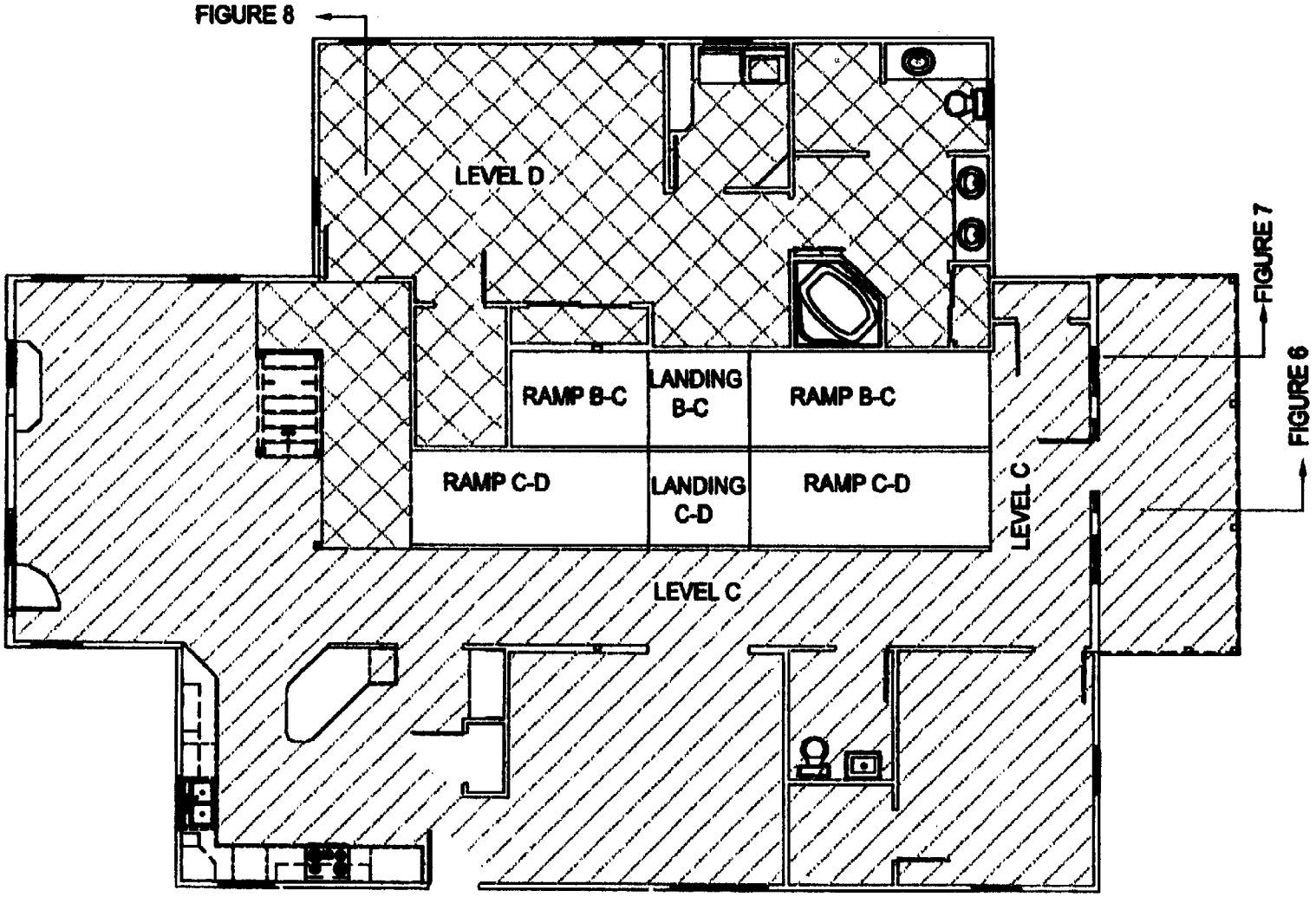
FIG. 5 shows a plan view of a single-family residential building design that incorporates this invention, depicting levels C and D and indicating the location within this design of sectional views that are themselves depicted in FIGS. 6, 7 and 8.
Figure 6:
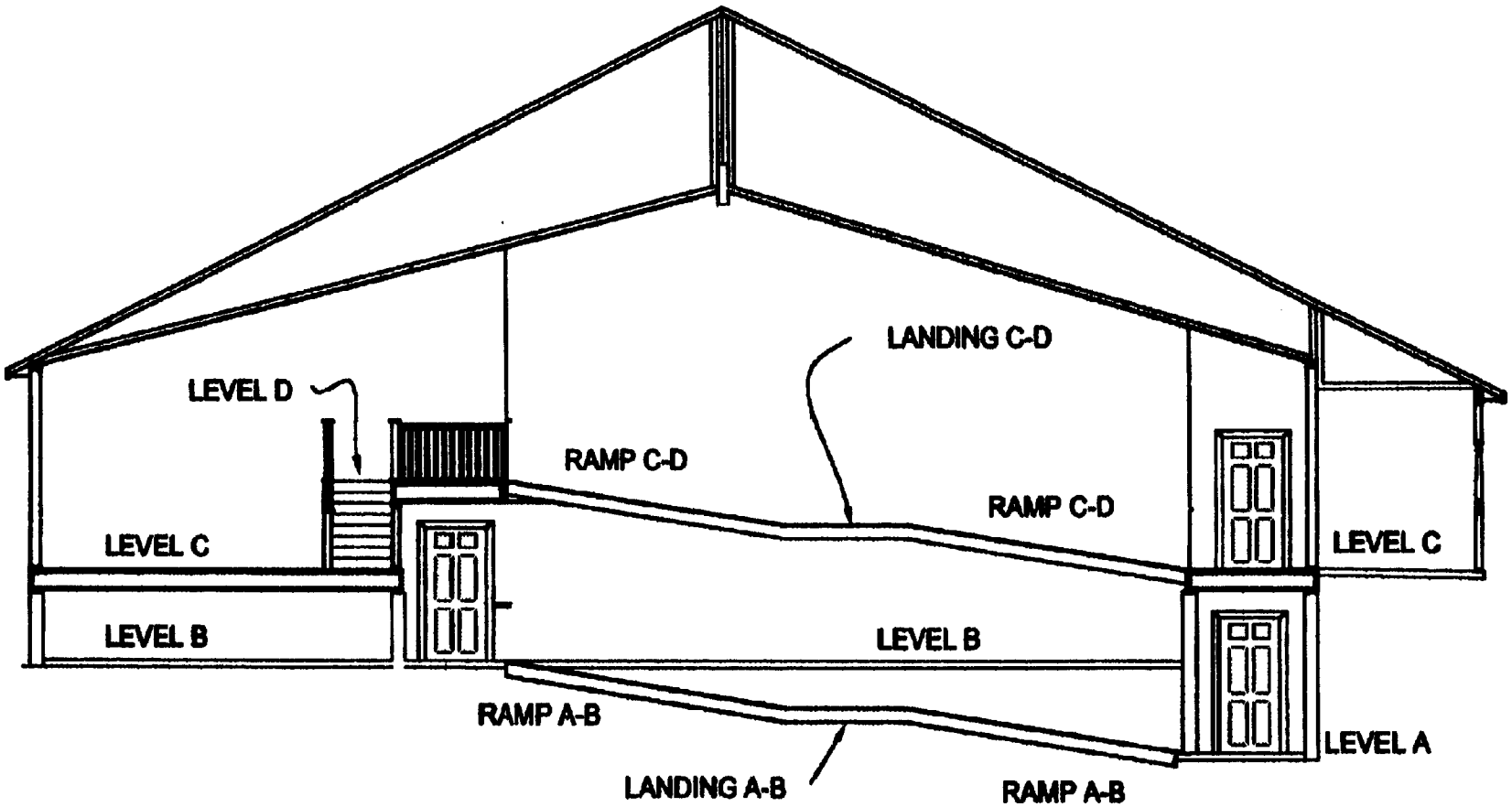
FIG. 6 shows a sectional view of a single-family residential building design that incorporates this invention, depicting levels A, B, C and D, and also depicting how the split-level ramp-well provides access to building environments that are off-set at half-story increments.
Figure 7:
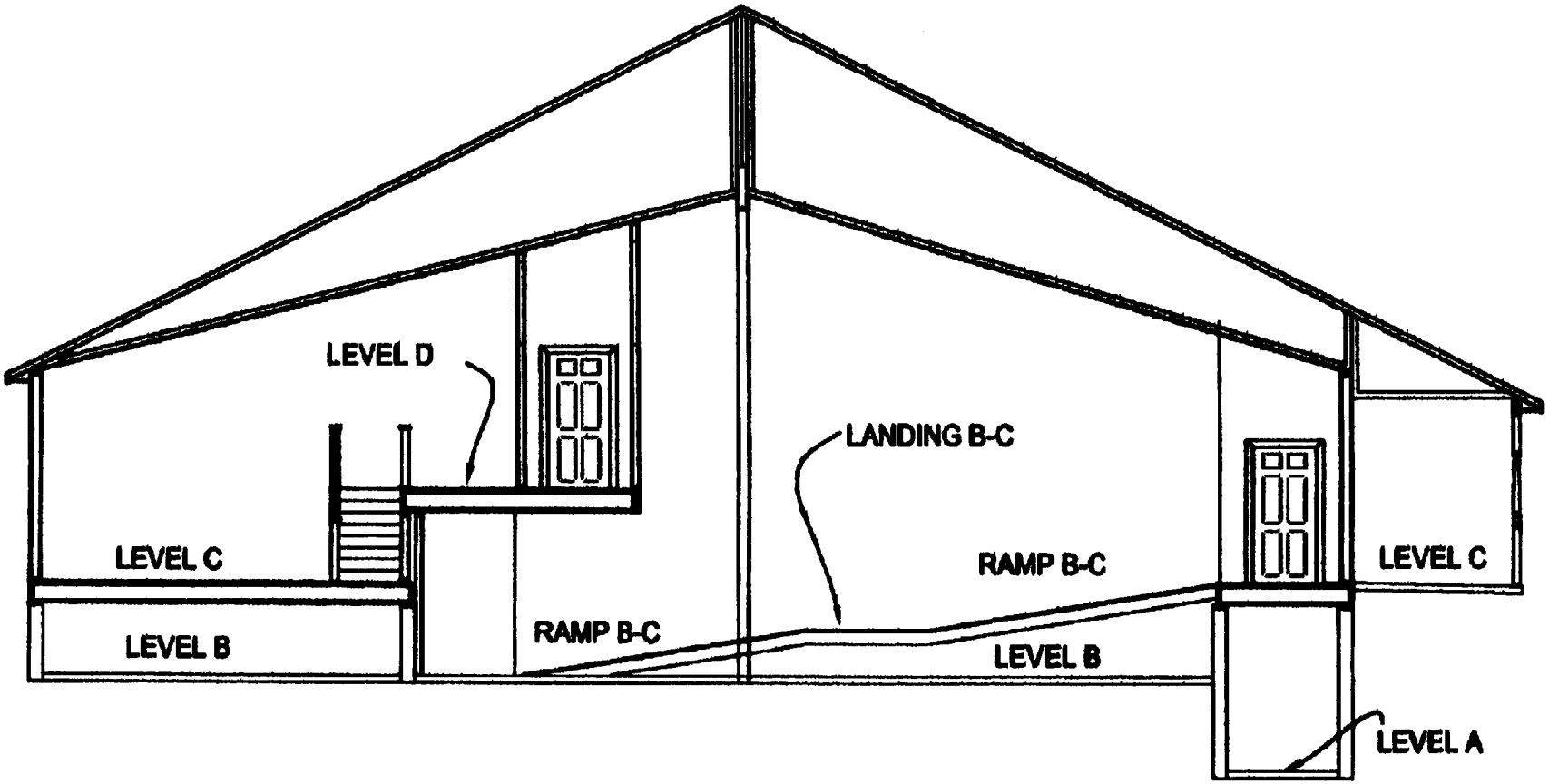
FIG. 7 shows a sectional view of a single-family residential building design that incorporates this invention, depicting levels A, B, C and D, and also depicting how the split-level ramp-well provides access to building environments that are off-set at half-story increments.
Figure 8:
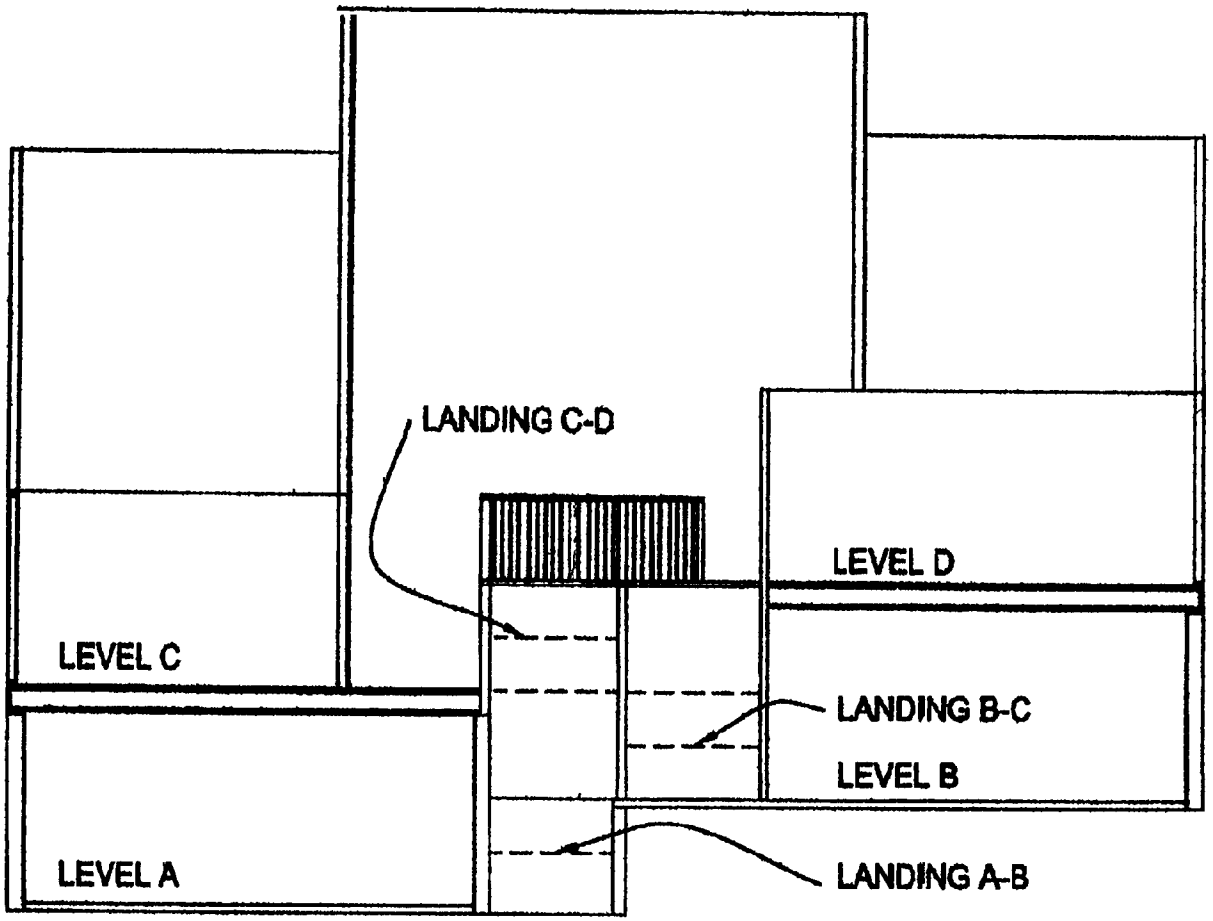
FIG. 8 shows a sectional view of a single-family residential building design that incorporates this invention, depicting levels A, B, C and D, and also depicting how the split-level ramp-well provides access to building environments that are off-set at half-story increments.
Figure 9:
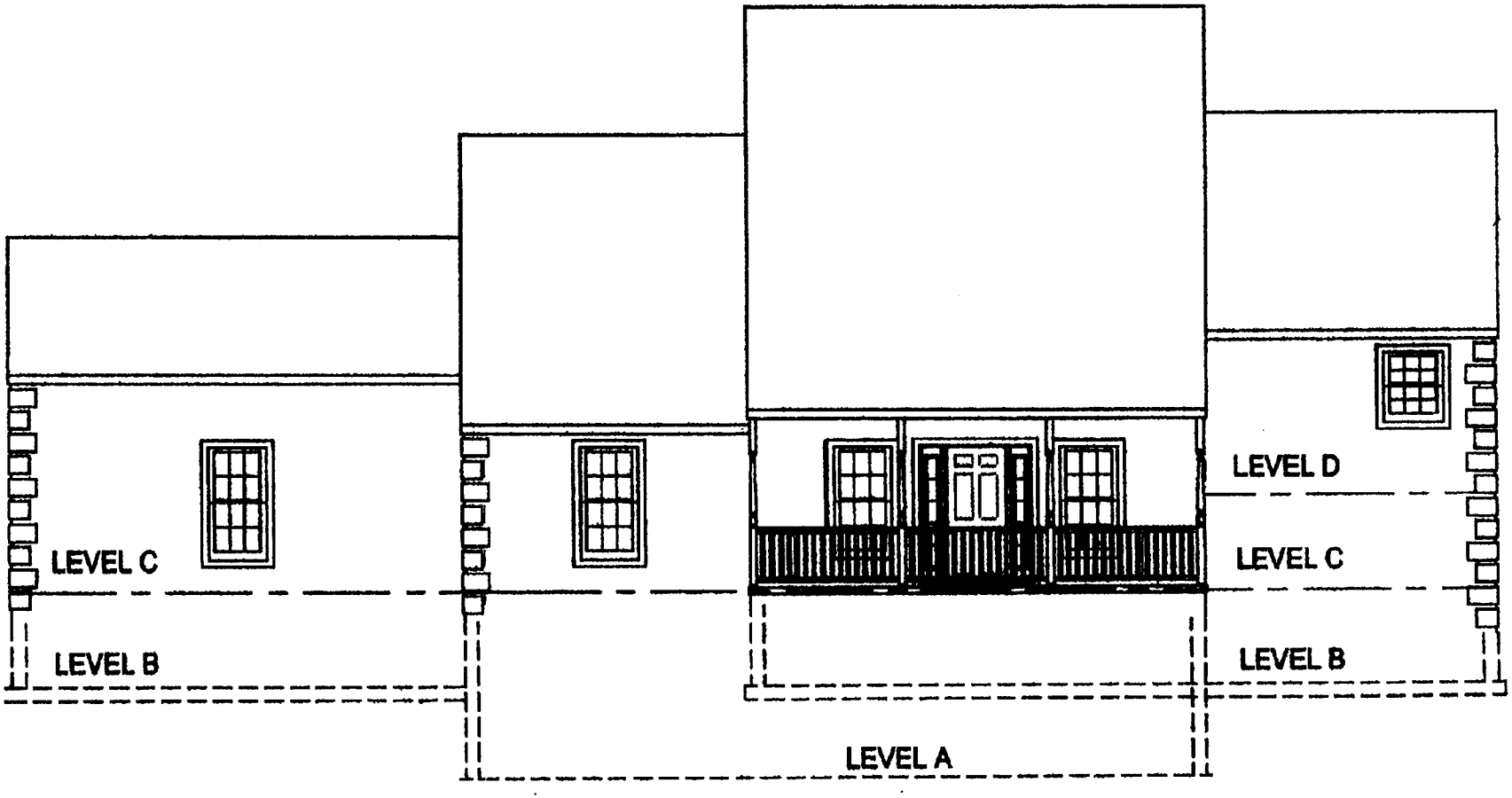
FIG. 9 shows an exterior front elevation of a single-family residential building design showing all four building levels that incorporates this invention, as depicted in FIGS. 4, 5, 6, 7 and 8.
Figure 10:
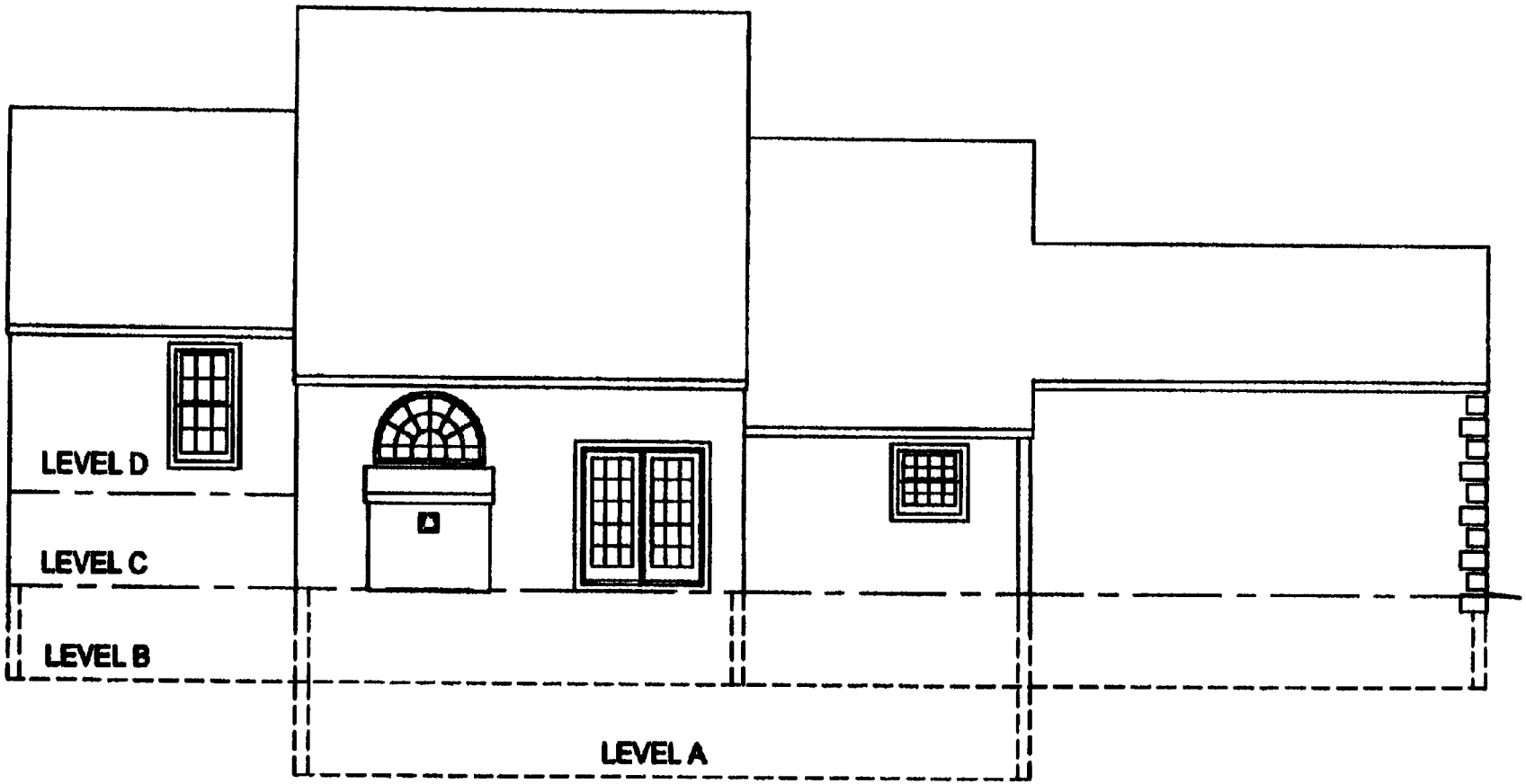
FIG. 10 shows an exterior rear elevation of a single-family residential building design showing all four building levels that incorporates this invention, as depicted in FIGS. 4, 5, 6, 7 and 8.
Figure 11:
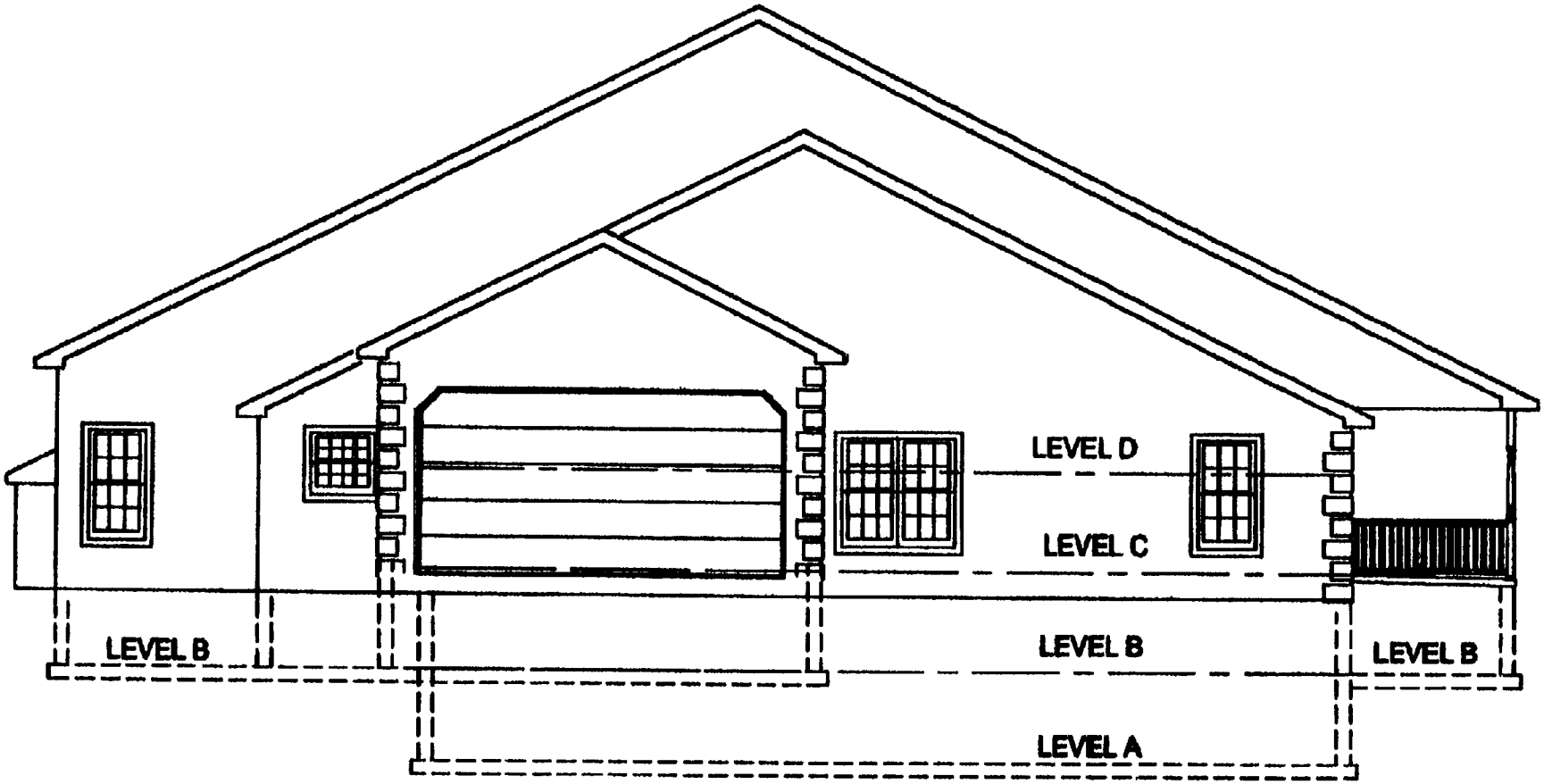
FIG. 11 shows an exterior left elevation of a single-family residential building design showing all four building levels that incorporates this invention, as depicted in FIGS. 4, 5, 6, 7 and 8.
Figure 12:
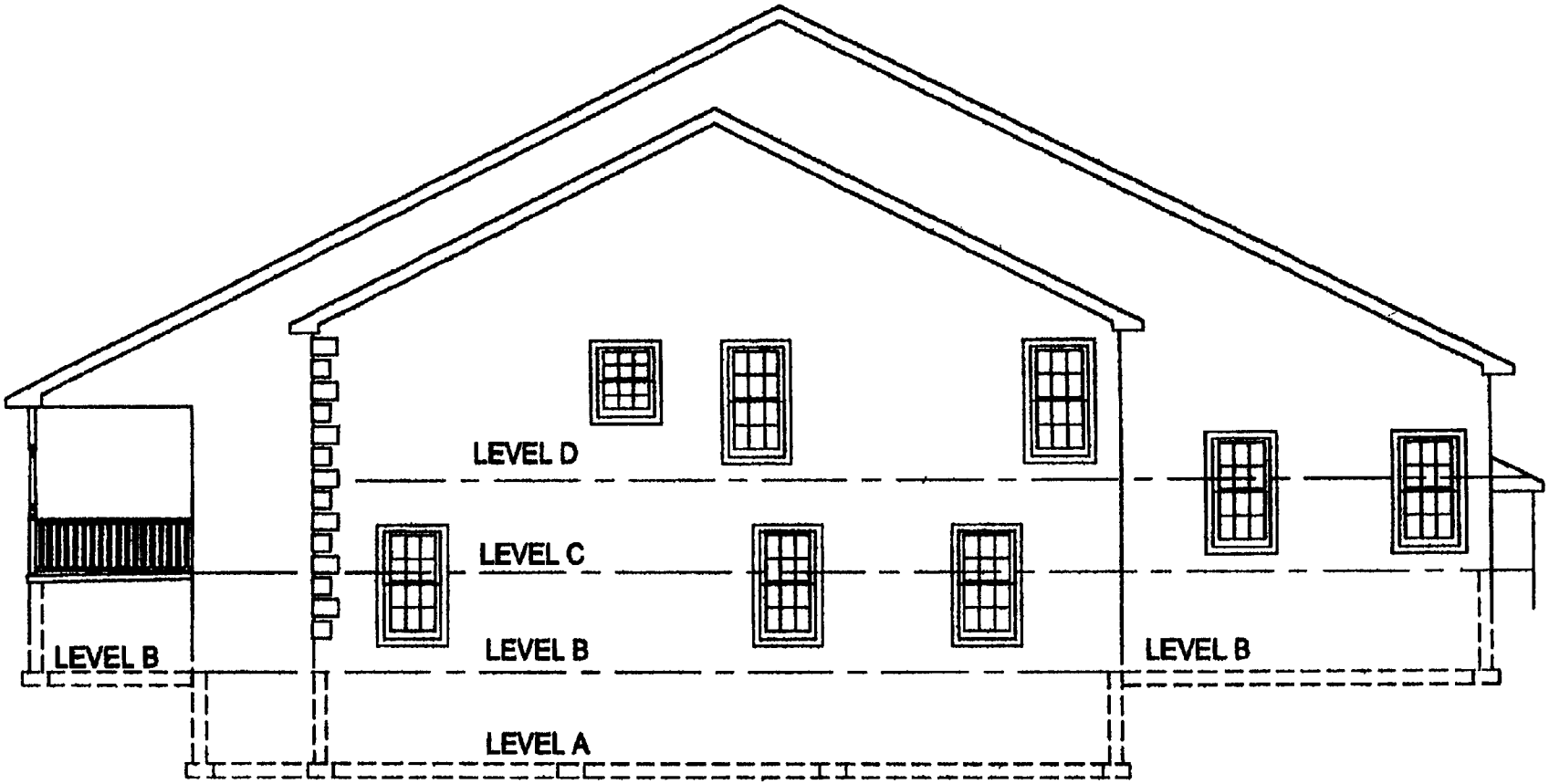
FIG. 12 shows an exterior right elevation of a single-family residential building design showing all four building levels that incorporates this invention, as depicted in FIGS. 4, 5, 6, 7 and 8.

In the design of the present invention shown schematically in FIG. 1, ramps connecting the half levels are constructed in a ramp well much as stairs are constructed in stair wells in typical multiple story construction. However, ramps joining each successive level are offset from one another in a side-by side configuration as shown in FIG. 4 and FIG. 5. (In some houses an intermediate landing for steps is used with a switch-back layout which reverses the direction of the stairs midway and also places the steps in a side by side arrangement.) The side by side ramp design therefore occupies twice the width of standard stairway wells, but the same amount of width as switch-back stairs. However, as a consequence of this design, it is important to note that for each ramp there is a full standard height of approximately 8 feet between the ramp surface and the ceiling above the ramp surface formed by the bottom of the ramp starting two levels above. This can be clearly seen in the schematic of FIG. 1. Thus, even though the ramps span just a half level each, full height above each ramp is preserved.

The building that is depicted in FIG. 4 through FIG. 12 uses a 16.07% slope. This present design for incorporating ramps that are both affordable and of reasonable length into residential multi-level building construction has heretofore not been known. Very little additional construction costs over that of a standard multiple story dwelling are encountered with the design of the present invention. Additionally, smaller and more affordable buildings can be designed using this method, providing safe and comfortable non-mechanical access between multiple building levels. From a functional point of view, the ramp-well either can be located between or can cut across the various levels. Because of the striking visual effect when the ramps are in the middle of the house, this is the preferred design.

Figure 3A:
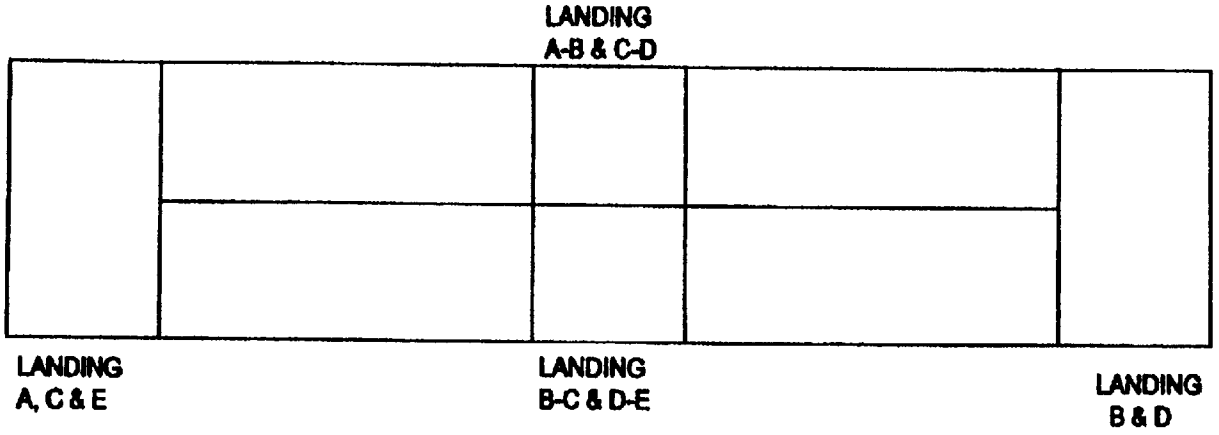
FIG. 3A and FIG. 3B show a split-level ramp-well, plan view, depicting how the ramps are built side-by-side, thereby providing access to building environments that are off-set at half-story increments. Additionally.
Figure 3B:
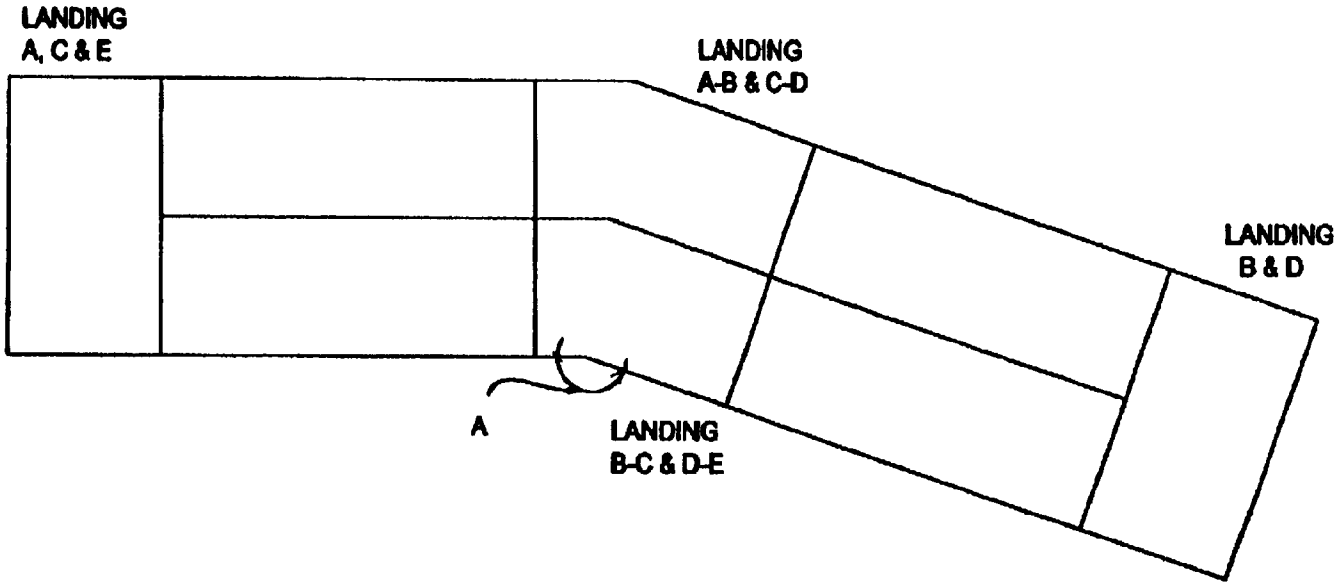

For those cases for people requiring the shallowest slopes, thereby increasing the length of the ramps that are required, in order not excessively extend the side-to-side or front-to-back dimensions of the house, the ramps can be built with a 90 degree angle (or with other angles A as shown in FIG. 3B as desired) at the intermediate landing. However, multiple turns within the ramp-well (approximating spirals and other configurations found in buildings such as in parking garages) so increase the construction complexity, the building footprint, and the total building costs that such designs involving multiple turns within the ramp-well are impractical for most residential designs.

A barrier-free residential house having four floors would be designed and constructed according to the following schematic procedure:

1. Create two or more full-ceiling-height building levels that are stacked one above the other in a group;

2. Create two or more :such vertically stacked groups;

3. Off-set the two groups of such vertically stacked full-ceiling-height groups of building levels in such a way that the relative building levels of each such vertically stacked group is one-half of a level of height higher (or lower) than the other vertically stacked group;

4. Create one or more sets of stacked half-height ramps that are similar in lay-out to what is depicted in FIGS. 1, 2 and 3 to form a split-level ramp-well.

5. Connect these off-set groups of building levels by using half-level-high ramps (with or without intermediate landings within the ramps) which ramps are themselves built side-by-side as well as above one-another, thereby minimizing the footprint of the ramp-well within the entire building.

Clearly, it can be seen that this procedure can be extended to accommodate anywhere from 3 or more building levels. In general there are two different and cost-effective ways to position the groups of stacked full-ceiling-height building levels in relationship to one-another and in relationship to the split-level ramp-wells. Specifically, the groups of building levels can be positioned side-by side with the connecting split-level ramp well positioned perpendicular to the axis that separates the two off-set groups of building levels; or, in the alternative, the groups of stacked building levels can be positioned on either side of (i.e. parallel to) the split-level ramp-well as is the case in the building example that is depicted in FIG. 4 through FIG. 12.

The design of the present invention constructively combines split-level building design with stacked ramps to minimize the length and area used by ramps, thereby providing the lowest-cost solution to non-mechanical barrier-free access to multi-level building environments for both handicapped and non-handicapped individuals. The design of the present invention can also be used to minimize development costs for buildings that are situated on steeply sloped building sites by orienting the split-level ramp-well (s) so they are parallel to the slope of the ground, thereby reducing excavation and related infrastructure effort and expense. The design of the present invention can also be used to connect off-set levels of existing split-level design buildings by adding an addition containing the split-level ramp-well onto the existing building. Such additions would enable individuals with impaired mobility to continue living in their present homes without relying on mechanical devices (i.e. elevators, wheel-chair lifts, stair-climbing chairs, etc.). For some people, the availability of adding the ramp-wells of this invention to their present split level homes will mean the difference between being able to remain in their existing home rather than having to move into an assisted-care or nursing facility.

The ramp wells of the present invention may also be used to provide a non-mechanical fail-safe and fire-safe means to enter and to exit buildings (both public and private), a feature that is particularly needed for individuals with impaired mobility.

The present invention can also be applied to the internal lay-out and design of multi-level town-houses, apartments and condominiums to provide non-mechanically assisted access both within individual living units, and between individual living units and to spaces outside of the larger building units.

Various modifications and alterations can be made by those skilled in the art to the present invention to accommodate different requirements. All such modifications which incorporate barrier-free access by ramps between half height building levels are considered to fall within the scope of this disclosure and appended claims.

I claim:

1. A barrier-free handicap accessible residence in which adjacent residential levels within the residence are connected by ramps comprising:

a) residence having four or more full story residential levels, said levels being divided between a first set and a second set, said second set having an equal or one fewer level than the first set, wherein the full story residential levels in each set are stacked above one another and the two sets of stacked residential levels are adjacent one another;

b) said residence in which each full story level in one set is offset from the next highest or lowest full story level in the other set by one-half story;

c) a first set of ramps which begin on levels separated by a full story and are similarly sloped and are stacked one above the other with the lowermost ramp of the ramp set starting at the lowermost residential level in the set of residential levels; and d) a second set of ramps which begin on levels separated by a full story similarly sloped and stacked one above the other with the lowermost ramp of the ramp set starting at the lowermost residential level in the second set of residential levels but which residential levels are offset from the residential levels of the first set of ramps by one-half story wherein each ramp connects residential levels separated in elevation by one-half story.

2. The residence of claim 1 in which the first and second set of ramps are built side by side and have opposing ascending and descending slopes to form a ramp well.

3. The residence of claim 2 in which one or more ramps have intermediate landings.

4. The residence of claim 2 in which the ramp well is located between the first set of building residence levels and the second set of building residence levels.

5. The residence of claim 4 in which one or more ramps have intermediate landings.

6. A barrier-free handicap accessible residential residence in which all residential levels are connected by ramps comprising:

a) a first set of full story residential levels that are stacked one above another in a group;

b) a second set of full story residential levels that are stacked one above another in a group and are offset in relative height by one-half story from the first set;

c) one or more ramp wells further comprising:

(1) a first set of ramps which begin on levels separated by a full story and are similarly sloped and are stacked one above the other with the lowermost ramp of the ramp set starting at the lowermost residential level in the set of residential levels; and (2) a second set of ramps which begin on levels separated by a full story similarly sloped and stacked one above the other with the lowermost ramp of the ramp set starting at the lowermost residential level in the second set of residential levels but which residential levels are offset from the residential levels of the first set of ramps by one-half story wherein each ramp connects a residential level in the first set with a residential level in the second set which is separated in elevation by one-half story.

7. The residence of claim 6 in which the first and second set of ramps are built side by side and have opposing ascending and descending slopes to form a ramp well.

8. The residence of claim 7 in which one or more ramps have intermediate landings.

9. The residence of claim 7 in which the ramp well is located between the first set of building residence levels and the second set of building residence levels.

10. The residence of claim 9 in which one or more ramps have intermediate landings.

11. A barrier-free handicap accessible residence in which all residential levels are connected by ramps comprising:

a) two or more sets of full story residential levels that are stacked one above another in a group;

b) one or more ramp wells further comprising:

(1) a first set of ramps which begin on levels separated by a full story and are similarly sloped and are stacked one above the other with the lowermost ramp of the ramp set starting at the lowermost residential level in the set of residential levels; and (2) a second set of ramps which begin on levels separated by a full story similarly sloped and stacked one above the other with the lowermost ramp of the ramp set starting at the lowermost residential level in the set of residential levels but which residential levels are offset from the residential levels of the first set of ramps by one-half story wherein each ramp connects a residential level in one group with a residential level in an adjacent group which is separated in elevation by one-half story.

12. The residence of claim 11 in which the first and second set of ramps are built side by side and have opposing ascending and descending slopes to form a ramp well.

13. The residence of claim 12 in which one or more ramps have intermediate landings.

14. The residence of claim 11 in which ramp wells are located between the sets of residential levels.

15. The residence of claim 14 in which one or more ramps have intermediate landings.

16. A method of constructing a barrier-free handicap accessible residence in which all residential levels are connected by ramps comprising the following steps:

a) constructing two or more full-ceiling-height residential levels that are stacked one above the other in a group;

b) constructing two or more such vertically stacked groups;

c) off-setting two or more groups of such vertically stacked groups so that the residential levels of each such vertically stacked group are one-half of a level of height higher or lower than the residential levels of an adjacent vertically stacked group;

d) constructing one or more ramp wells comprising:

(1) a first set of ramps which begin on levels separated by a full story and are similarly sloped and are stacked one above the other with the lowermost ramp of the ramp set starting at the lowermost residential level in a first group of residential levels; and (2) a second set of ramps which begin on levels separated by a full story similarly sloped and stacked one above the other with the lowermost ramp of the ramp set starting at the lowermost residential level in a next group of residential levels but which residential levels are offset from the residential levels of the first group of ramps by one-half story; and e) locating the ramp wells adjacent to the off-set groups so that each ramp in a ramp well connects a residential level in one group with a residential level in an adjacent group which is separated in elevation by one-half story.

17. The method of claim 16 in which the first and second set of ramps are built side by side and have opposing ascending and descending slopes to form a ramp well.

18. The method of claim 17 in which one or more ramps are built with intermediate landings.

19. The method of claim 16 in which the ramp wells are located between the vertically stacked groups.

20. The method of claim 19 in which one or more ramps are built with intermediate landings.

21. A barrier-free handicap accessible residence in which adjacent residential levels are connected by ramps comprising:

a) a residence having four full story residential levels divided into a first set of two levels and a second set of two levels wherein the residential levels in each set are stacked one above the other;

b) said residence in which each full story residential level is offset from the next highest or lowest level by one-half story;

c) a first ramp which begins on the lowest residential level and ends on the next higher residential level;

d) a second ramp which begins on the residential level immediately above the lowest residential level and ends on the next higher residential level; and e) a third ramp, which begins on the residential level one full story above the lowest residential level and ends on the next higher residential level, and is similarly sloped and stacked above the ramp leading from the lowest residential level wherein each ramp connects residential levels separated in elevation by one-half story.

22. The residence of claim 21 in which the first and second set of ramps are built side by side and have opposing ascending and descending slopes to form a ramp well.

23. The residence of claim 22 in which one or more ramps have intermediate landings.

24. The residence of claim 21 in which the ramp well is located between the first set of building residence levels and the second set of building residence levels.

25. The residence of claim 24 in which one or more ramps have intermediate landings.

26. A barrier-free handicap accessible residence in which adjacent residential levels are connected by ramps comprising:

a) a building residence having four residential levels;

b) a lowest residential level A that connects to the next highest residential level B by a first ramp, wherein residential levels A and B are vertically separated by one-half story and are not above one another;

c) a third residential level C that is one full story above residential level A and that connects to residential level B by a second ramp which is not above the first ramp; and d) a fourth residential level D that is one full story above residential level B and that connects to residential level C by a third ramp which is sloped and stacked one story above the ramp that connects residential levels A and B wherein each ramp connects levels separated in elevation by one-half story.

* * * * *